US006828882B2

(12) United States Patent
Hidaka et al.

(10) Patent No.: US 6,828,882 B2
(45) Date of Patent: Dec. 7, 2004

(54) MULTI-SPIRAL ELEMENT, RESONATOR, FILTER, DUPLEXER, AND HIGH-FREQUENCY CIRCUIT DEVICE

(75) Inventors: Seiji Hidaka, Nagaokakyo (JP); Yasuo Fujii, Yokohama (JP); Shin Abe, Muko (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 142 days.

(21) Appl. No.: 10/243,929

(22) Filed: Sep. 16, 2002

(65) Prior Publication Data

US 2003/0056977 A1 Mar. 27, 2003

(30) Foreign Application Priority Data

Sep. 17, 2001 (JP) ..... 2001-281943

(51) Int. Cl.[7] ..... H01P 3/08

(52) U.S. Cl. ..... 333/204; 333/161; 333/185; 333/219

(58) Field of Search ..... 333/156, 161, 333/185, 204, 219, 236, 238, 245, 246

(56) References Cited

U.S. PATENT DOCUMENTS 4,757,285 A * 7/1988 Krause ..... 333/203
4,981,838 A 1/1991 Whitehead
5,818,308 A * 10/1998 Tanaka et al. ..... 333/116
6,108,569 A * 8/2000 Shen ..... 505/210
6,486,754 B1 * 11/2002 Hidaka et al. ..... 333/219

FOREIGN PATENT DOCUMENTS

EP 1 109 246 A1 6/2001
GB 2 351 615 A 1/2001

OTHER PUBLICATIONS

Ong et al., "High Temperature Superconducting Bandpass Spiral Filter", IEEE Microwave and Guided Wave Letters, vol. 9, No. 10, pp. 407–409 (1999).

* cited by examiner

*Primary Examiner*—Robert Pascal
*Assistant Examiner*—Kimberly Glenn
(74) *Attorney, Agent, or Firm*—Dickstein, Shapiro, Morin & Oshinsky, LLP.

(57) ABSTRACT

A multi-spiral element includes a group of spiral conductive lines arranged so as not to cross each other so that the spiral conductive lines are substantially rotationally symmetric with respect to a predetermined point on a dielectric substrate. A plurality of conductive lines in the group of spiral conductive lines have external peripheral ends aligned at a substantially straight line substantially orthogonal to the group of spiral conductive lines. The external peripheral ends of each of the plurality of conductive lines in the multi-spiral element are connected to respective ends of a straight-line-group element having a group of parallel straight conductive lines. A resonator includes the multi-spiral elements functioning as capacitors for accumulating a charge, and the straight-line-group element functioning as an inductor.

20 Claims, 18 Drawing Sheets

21

FIG. 18A
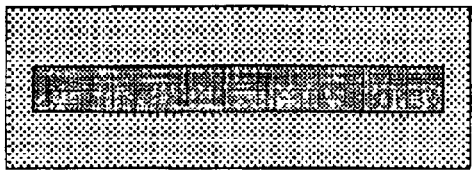
WAVELENGTH SHORTENING EFFECT
1.00 (REFERENCE)
FIG. 18B
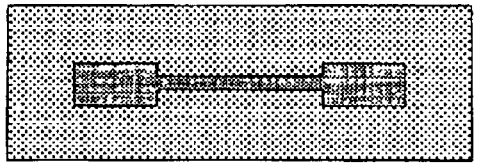
0.78
FIG. 18C
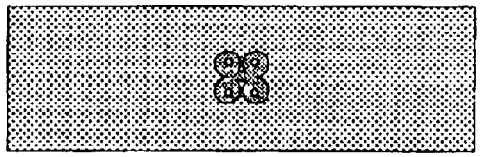
FIG. 18D
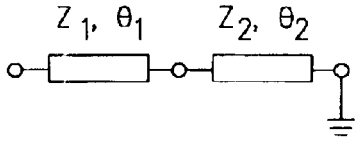
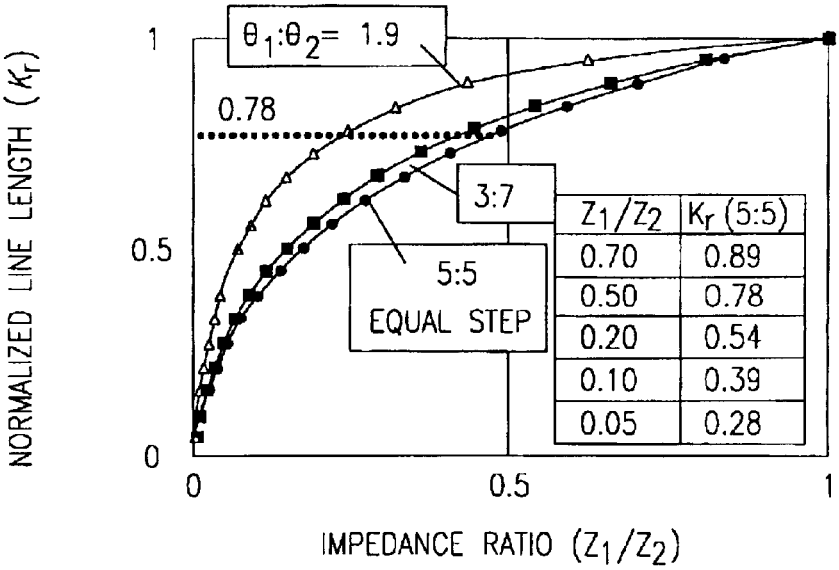
| $Z_1/Z_2$ | $K_r$ (5:5) |
|---|---|
| 0.70 | 0.89 |
| 0.50 | 0.78 |
| 0.20 | 0.54 |
| 0.10 | 0.39 |
| 0.05 | 0.28 |
FIG. 18E

MULTI-SPIRAL ELEMENT, RESONATOR, FILTER, DUPLEXER, AND HIGH-FREQUENCY CIRCUIT DEVICE

BACKGROUND OF THE INVENTION

1. Field of the Invention

The present invention relates to a circuit element, a resonator, a filter, a duplexer, and a high-frequency circuit device, for example, used in the microwave band or millimeter wave band, for use in wireless communication devices or electromagnetic wave transmission/reception devices.

2. Description of the Related Art

Typically, planar resonators used in the microwave band or millimeter wave band are formed of a planar circuit, such as a microstrip line, placed on a dielectric substrate.

Compact planar resonators having the above configuration are disclosed in the following references:

(1) Ikuo AWAI, "Planar Microwave Filters", MWE 2000 Microwave Workshop Digest, pp. 445–454, 2000; and (2) Morikazu SAGAWA and Mitsuo MAKIMOTO, "Geometrical Structure and Fundamental Characteristics of Microwave Stepped-Impedance Resonators", Technical Report of IEICE, SAT95-76, MW95-118 (1995-12), pp. 25–30, 1995.

The resonators disclosed in the above references comprise a so-called stepped-impedance resonator having a line whose width is stepped so as to provide a low impedance at an open side thereof and a high impedance at a shorted side thereof. That is, when the impedance at the open side of a resonator line is high and the impedance at the shorted side is low, and the impedance ratio is greater, the wavelength shortening effect increases, thus allowing the overall resonator to be compact.

The wavelength shortening effect is now described with reference to FIGS. 18A to 18E.

FIG. 18A depicts the line pattern of a resonator having a stepless structure, and FIG. 18B depicts the line pattern of a stepped-impedance resonator. FIG. 18C depicts a resonator according to an embodiment of the present invention, as described below. FIG. 18D is an equivalent circuit diagram of the resonators depicted in FIGS. 18A and 18B. FIG. 18E is a graph showing the relationship between the ratio of impedance Z1 at the open side and impedance Z2 at the shorted side and the normalized line length (wavelength shortening coefficient).

In FIG. 18D, Z1 denotes the impedance at the open side, Z2 denotes the impedance at the shorted side, θ1 denotes the electrical length at the open side, and θ2 denotes the electrical length at the shorted side.

For example, if θ1:θ2=5:5, i.e., with a stepped-impedance resonator in which the length at the open side is equal to the length at the shorted side, where Z1/Z2=0.5, then the normalized line length $k_r$ will be 0.784. Thus, the stepped-impedance resonator shown in FIG. 18B has a resonator line whose line length is reduced by a factor of about 0.78 with respect to the resonator, shown in FIG. 18A, which is not a stepped-impedance resonator.

The wavelength shortening effect is highest when θ1:θ2=5:5, i.e., an equal step.

In order to achieve a high wavelength shortening effect using such a stepped-impedance resonator, the impedance ratio must be high. However, the line width of the low-impedance portion cannot be so large since the area on a dielectric substrate is restricted, resulting in a relatively small line width at the high-impedance portion. Thus, the resonator operates with the small-line-width portion exhibiting a peak in the current distribution, thereby causing high conductor loss and low Q in the resonator.

The problem of low Q must be overcome not only in resonators, but also in other high-frequency circuit elements such as capacitors. It is also important to improve the compatibility when connecting such elements to a low-loss line to form a circuit.

SUMMARY OF THE INVENTION

Accordingly, it is an object of the present invention to provide a compact and low-loss conductive line element, and a resonator, a filter, a duplexer, and a high-frequency circuit device incorporating the conductive line element.

To this end, in one aspect, the present invention provides a multi-spiral element including a group of spiral conductive lines. The spiral conductive lines are arranged so as not to cross each other so that the spiral conductive lines are substantially rotationally symmetric with respect to a predetermined point on a substrate. A plurality of conductive lines in the group of spiral conductive lines have external peripheral ends aligned at a substantially straight line substantially orthogonal to the conductive lines.

In this configuration, one spiral conductive line is adjacent to another spiral conductive line having substantially the same configuration as that spiral conductive line, and a gap is formed between the conductive lines, through which a magnetic field orthogonal to the dielectric substrate extends. This prevents the magnetic field from being concentrated at the edges of an electrode so as to make the magnetic field uniform, thus mitigating the edge effect in each of the spiral conductive lines. Therefore, the current concentration at the edges of each spiral conductive line can be reduced. As a result, the overall conductor loss is reduced, thus reducing the loss in the multi-spiral element.

Since the external peripheral ends of the conductive lines in the multi-spiral element are aligned at a straight line substantially orthogonal to the conductive lines, the multi-spiral element can be readily connected to, for example, a straight-line-group element having a plurality of substantially straight conductive lines which are substantially parallel to each other so that the straight conductive lines do not cross the spiral conductive lines. Thus, loss at the connection therebetween can be minimized.

In another aspect, the present invention provides a resonator including the above multi-spiral element. The multi-spiral element is connected to each end of a straight-line-group element having a plurality of substantially straight conductive lines substantially parallel to each other.

The multi-spiral element serves as a compact and low-loss capacitor for accumulating a charge, while the straight-line-group element serves as a compact and low-loss inductor. Therefore, a compact and low-loss resonator can be achieved.

In still another aspect, the present invention provides a resonator including two of the above resonators. Each of the resonators is linearly symmetric, in which the spiral conductive lines in the multi-spiral elements connected to both ends of the straight-line-group element are reversely turned with respect to each other. The straight-line-group element in one of the resonators is adjacent to the straight-line-group element in the other resonator, and four of the multi-spiral elements are horizontally and vertically substantially symmetric with each other.

Therefore, the conductor loss can be reduced in the straight-line-group element, thus increasing the Q factor in the overall resonator.

In still another aspect, the present invention provides a filter in which a signal input and output unit is provided for the above-described resonator. A compact and low-insertion-loss filter can be therefore achieved.

In still another aspect, the present invention provides a duplexer including two of the above-described filters. The signal input and output unit comprises a transmission-signal input terminal, input and output terminals for transmission and reception, and a received-signal output terminal. A compact and low-insertion-loss duplexer can be therefore achieved.

In still another aspect, the present invention provides a high-frequency circuit device including the above-described multi-spiral element, the above-described resonator, the above-described filter, or the above-described duplexer. A compact and low-insertion-loss high-frequency circuit can be therefore achieved. A communication apparatus incorporating such a high-frequency circuit can increase communication quality including a noise characteristic and a transmission rate.

BRIEF DESCRIPTION OF THE DRAWINGS

FIGS. 18A and 18B are schematic diagrams of resonators in the related art, FIG. 18C is a schematic diagram of the resonator shown in FIG. 8 for reference, FIG. 18D is an equivalent circuit diagram of the resonators shown in FIGS. 18A and 18B, and FIG. 18E is a graph showing characteristics in the wavelength shortening effect.

DESCRIPTION OF THE PREFERRED EMBODIMENTS

The configuration of a multi-spiral element according to a first embodiment of the present invention is now described with reference to FIGS. 1 to 5.

Figure 2:
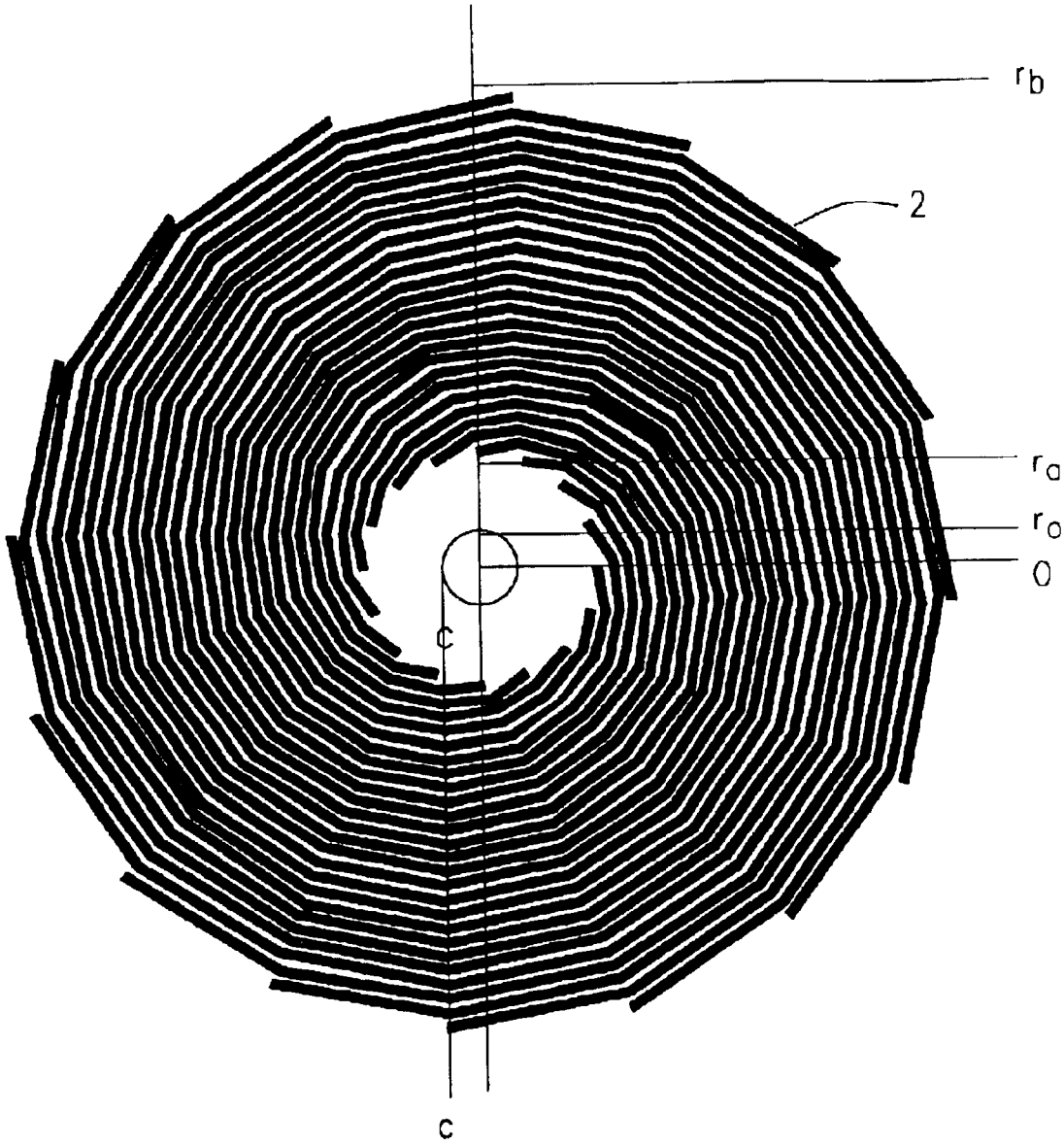
FIG. 2 is a schematic diagram of the prototype based on which the multi-spiral element shown in FIG. 1 is formed.

FIG. 2 shows a group of spiral conductive lines formed on a dielectric substrate, which is the prototype based on which a multi-spiral element discussed below is formed so that the external peripheral ends of the spiral conductive lines are aligned. In FIG. 2, for convenience of illustration in the drawing, each spiral conductive line is angled so as to form substantially a polygon. Such angled conductive lines can also be regarded as substantially spiral conductive lines, and the angled conductive lines may actually be used in practice. In the prototype, 16 congruent spiral conductive lines 2 each having a minimum radius $r_0$, an inner radius $r_a$, and an outer radius $r_b$ are arranged at equiangular intervals so that the spiral conductive lines 2 are rotationally symmetric with respect to the centers of the above radii as the center of rotation so as not to cross each other.

Figure 1:
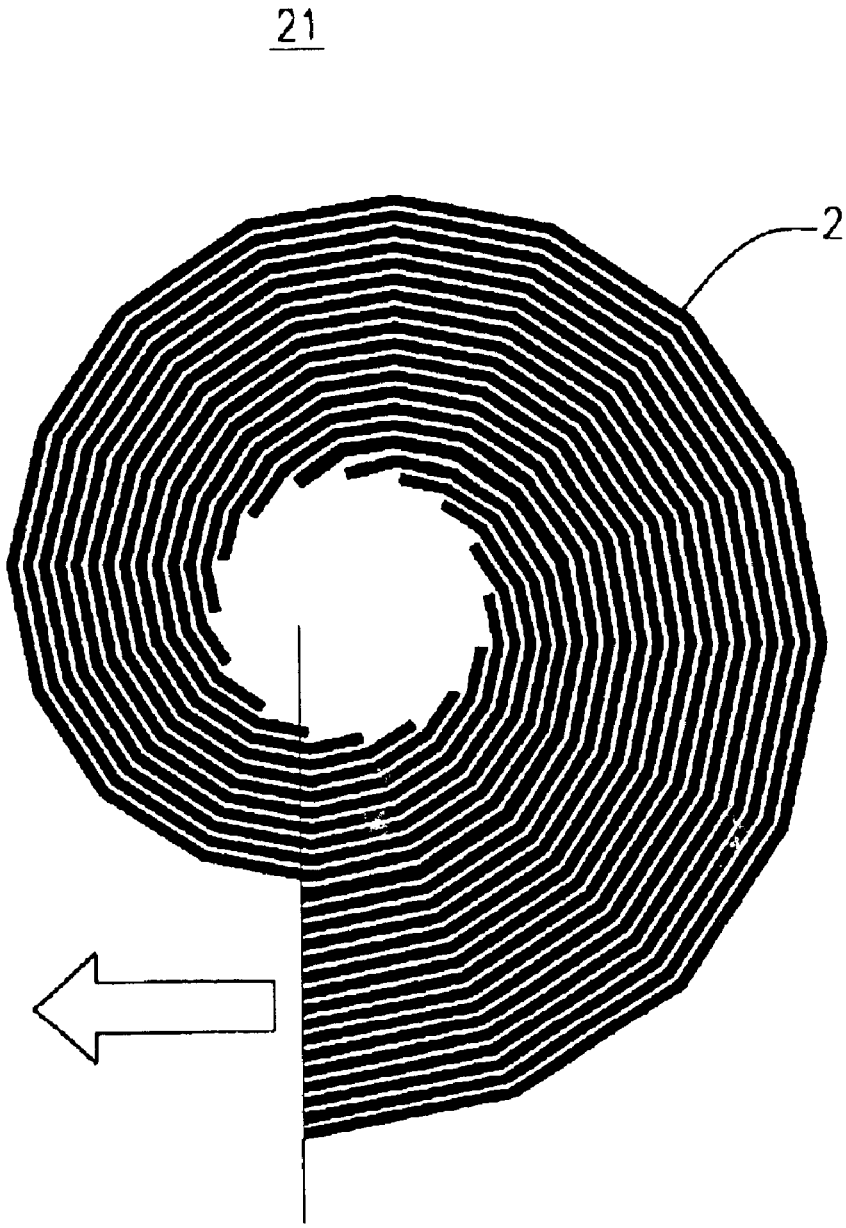
FIG. 1 is a schematic diagram of a multi-spiral element according to a first embodiment of the present invention.

FIG. 1 is a top plan view of a multi-spiral element 21. In FIG. 1, spiral conductive lines 2 are formed on a dielectric substrate. The multi-spiral element 21 shown in FIG. 1 is configured by forming the pattern of the spiral conductive lines 2 in the prototype shown in FIG. 2 so that the external peripheral ends of the spiral conductive lines 2 are aligned at a line C—C substantially orthogonal to the spiral conductive lines 2. The line C—C is an imaginary line at which the conductive lines in the prototype shown in FIG. 2 are cut in order to forcibly produce external peripheral ends of the conductive lines 2, and is hereinafter referred to as a "cut line". The cut line C—C is a tangent to a circle with the minimum radius $r_0$ shown in FIG. 2. The equations indicating the relationship between the spiral conductive lines 2 and the cut line C—C are described below.

In the example shown in FIG. 1, all external peripheral ends of the 16 spiral conductive lines 2 are aligned at the cut line C—C. Thus, although the spiral conductive lines 2 are not all congruent, the configuration of one spiral conductive line being adjacent to another spiral is the same as in the prototype shown in FIG. 2.

The multi-spiral element 21 functions as a unipole element. As discussed below, for example, two unipole elements with the above configuration which are connected through an inductor would function as capacitors for accumulating a charge in the two unipole elements.

Compared to an element including a series of electrodes (solid electrodes) having a predetermined width, rather than including a group of spiral conductive lines, i.e., a multi-line element, the multi-spiral element, serving as a unipole element, according to the first embodiment has the following advantages.

First, gaps between the spiral conductive lines 2 allow a magnetic field orthogonal to the dielectric substrate to pass through the gaps. This mitigates the edge effect in each of the spiral conductive lines 2, reducing the current concentration at the edges of each spiral conductive line 2. Therefore, the overall conductor loss is reduced, thus reducing the loss in the multi-spiral element.

Second, in the group of spiral conductive lines 2 the adjacent spiral conductive lines are different in line length, thereby producing a phase difference between the lines. Accordingly, an electrostatic capacitance (hereinafter simply referred to as "capacitance") is produced between the adjacent spiral conductive lines. The capacitance produced between the conductive lines can be used as a capacitor. The line gap may be extremely small, on the order of, for example, 1 $\mu$m to several micrometers. The width of the spiral conductive lines 2 may also be small. Therefore, a group of multiple spiral conductive lines can be arranged on a limited area of the dielectric substrate, and the opposing area between the lines can be significantly large. This ensures a large capacitance between the lines with respect to the area of the dielectric substrate.

Moreover, since the external peripheral ends of the plurality of spiral conductive lines 2 are aligned at the cut line, the multi-spiral element can be used as a multi-terminal circuit element, described below, which can be coupled with a group of parallel straight conductive lines. At the connections, the conductive lines 2 can be continuous, thus maintaining a low-loss characteristic without impedance mismatching.

The line length of the spiral conductive lines 2 may be reduced, thereby making it easy to design a high self-resonant frequency.

In this embodiment, no ground electrode is formed on the lower surface of the dielectric substrate so as to face the group of spiral conductive lines. Although there is no specific need for a ground electrode on the lower surface of the dielectric substrate, a ground electrode may be formed on the lower surface of the dielectric substrate in order to utilize a capacitance component which is produced between the spiral conductive lines 2 and the ground electrode. Alternatively, a ground electrode may be formed in order to achieve a shielding effect. These ground electrode-related matters also apply in the following modifications and embodiments.

Figure 3:
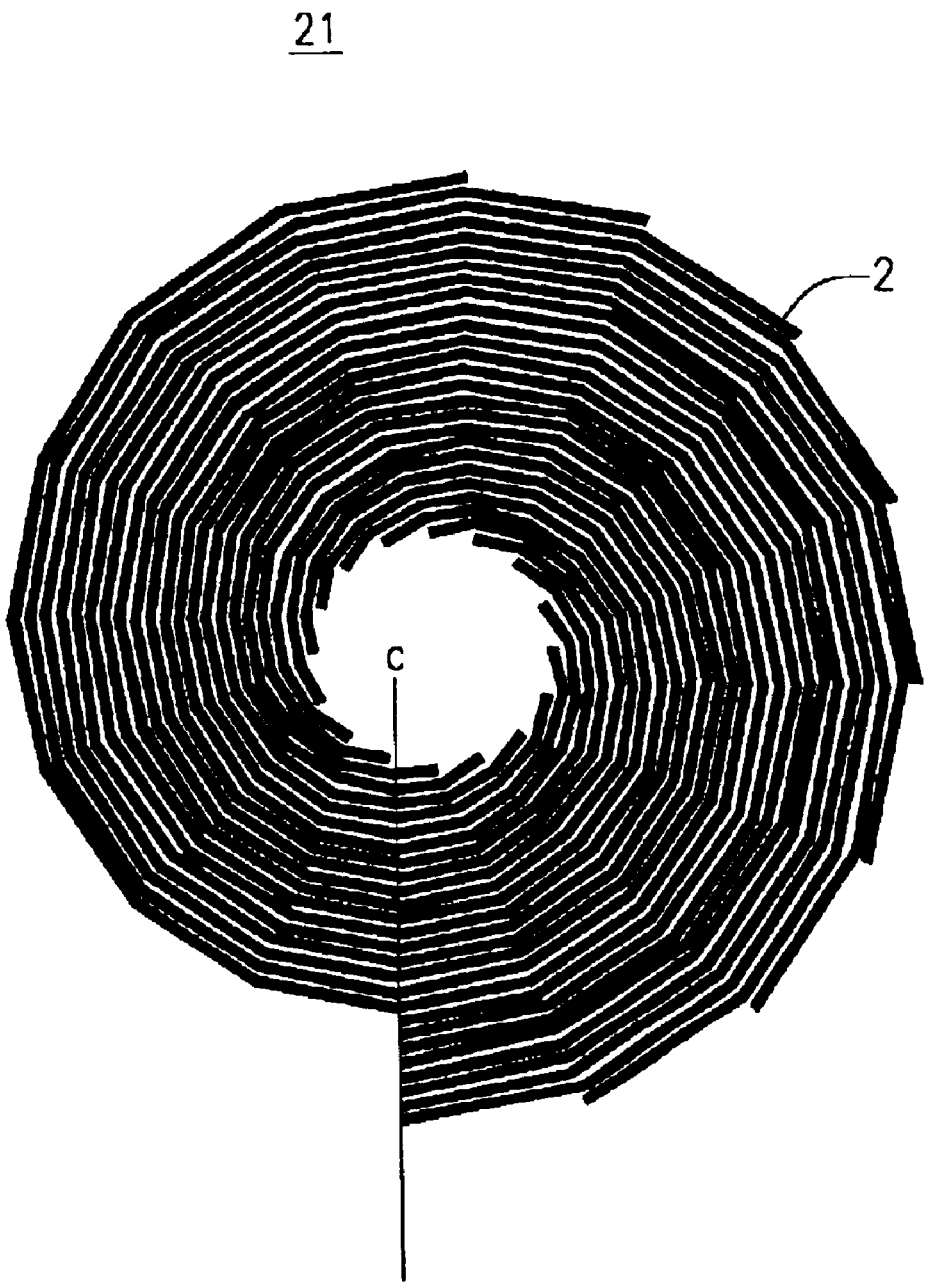
FIG. 3 is a schematic diagram of a modification of the multi-spiral element.
Figure 4:
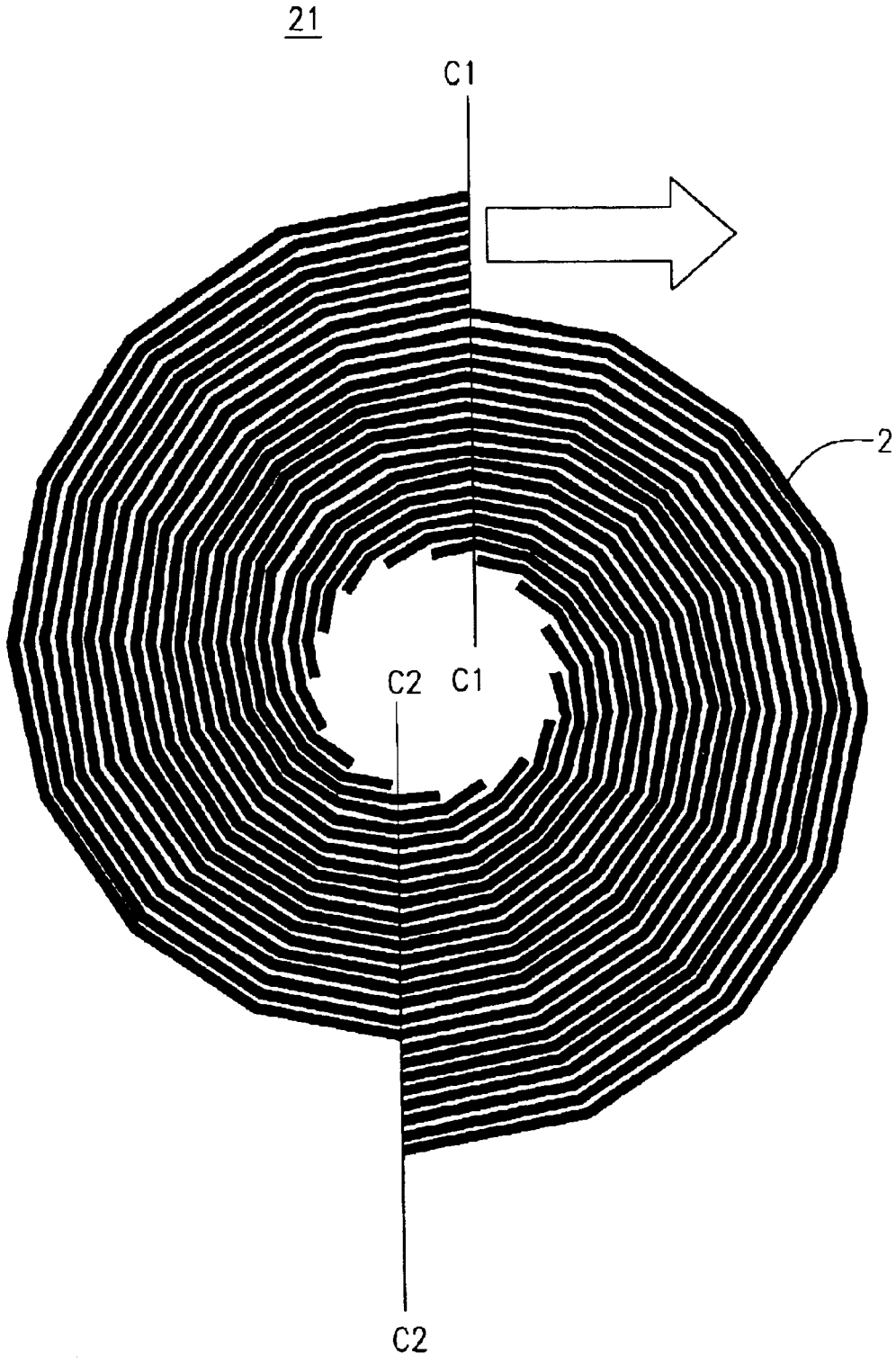
FIG. 4 is a schematic diagram of another modification of the multi-spiral element.
Figure 5:
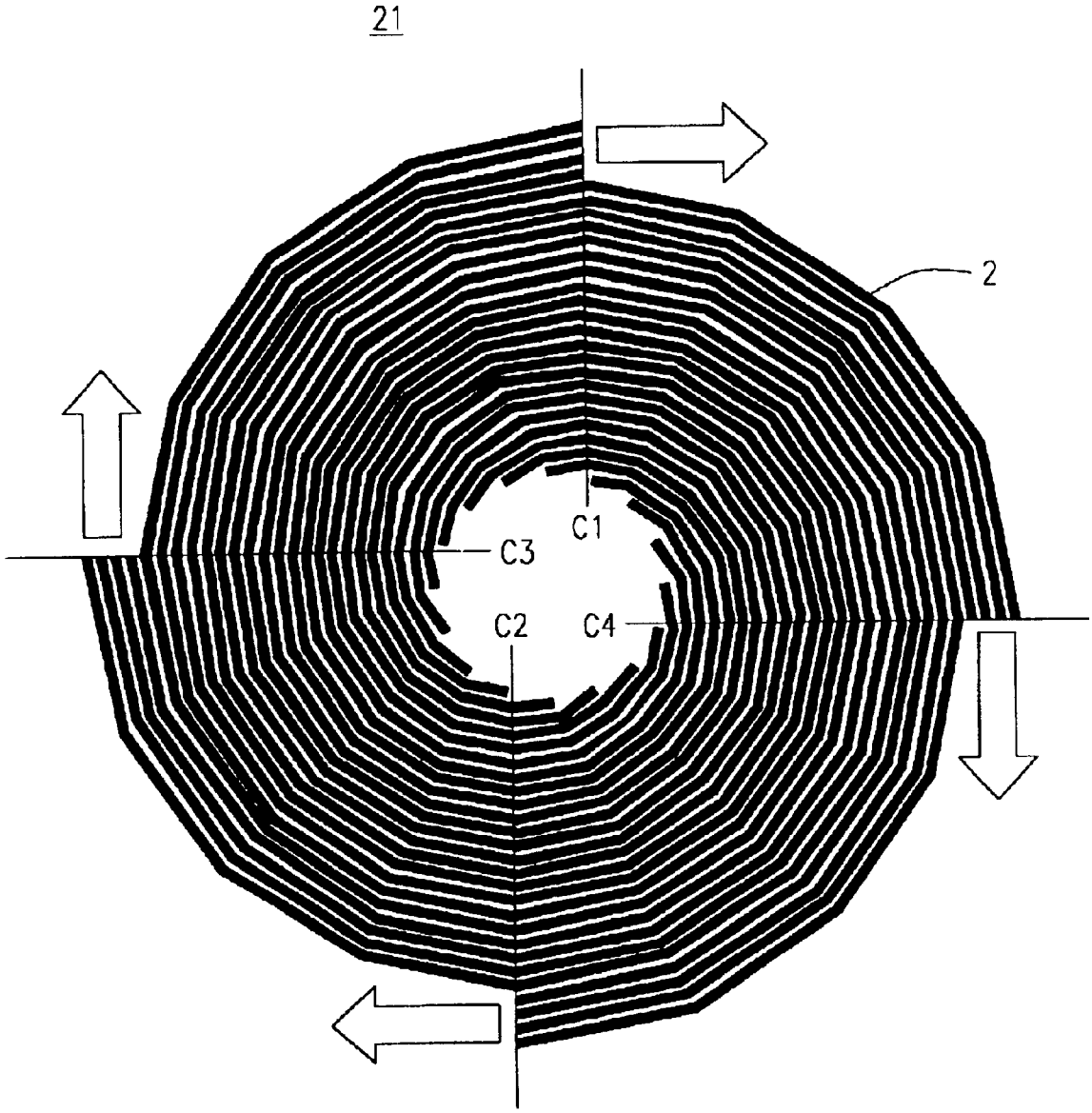
FIG. 5 is a schematic diagram of another modification of the multi-spiral element.

FIGS. 3 to 5 show modifications of the multi-spiral element 21 shown in FIG. 1 which have a group of spiral conductive lines with different patterns.

In the multi-spiral element 21 shown in FIG. 3, the outer eight spiral conductive lines (out of the 16 spiral conductive lines) have external peripheral ends aligned at a cut line C—C. Even when only some of the plurality of spiral conductive lines in the multi-spiral element are aligned at a cut line in the above manner, the adjacent spiral conductive lines are still electromagnetically coupled with each other. Thus, only some of the spiral conductive lines may be connected to a group of straight conductive lines.

As in the multi-spiral element shown in FIG. 1, the multi-spiral element 21 shown in FIG. 3 can also be readily connected to a group of parallel straight conductive lines, and no impedance mismatching occurs at the connections, thus maintaining a low-loss characteristic.

In the multi-spiral element 21 shown in FIG. 4, two groups of eight spiral conductive lines in the 16 spiral conductive lines have external peripheral ends aligned at cut lines C1—C1 and C2—C2, respectively.

The multi-spiral element 21 shown in FIG. 4 includes a group of spiral conductive lines whose outer periphery ends at the cut line C1—C1 and a group of spiral conductive lines whose outer periphery ends at the cut line C2—C2. The multi-spiral element 21 then serves as a capacitor for accumulating positive charge in one of the groups of spiral conductive lines and negative charge in the other group of spiral conductive lines. Two groups of straight conductive lines are connected to the multi-spiral element 21, as indicated by the arrows in FIG. 4, thus achieving the advantages when a capacitor is connected between the two groups of straight conductive lines.

Compared to an element including two wide spiral conductive lines rather than including a group of spiral conductive lines, i.e., a multi-line element, the multi-spiral element, serving as a capacitor according to the modification of the first embodiment, has the following advantages.

First, the gaps between the spiral conductive lines 2 allow a magnetic field orthogonal to the dielectric substrate to pass through the gaps. This mitigates the edge effect in each of the spiral conductive lines 2, reducing the current concentration at the edges of each spiral conductive lines 2. Therefore, the overall conductor loss is reduced, thus reducing the loss in the element.

Second, the group of spiral conductive lines 2 produces a capacitance between the adjacent spiral conductive lines, as previously described. The capacitance produced between the conductive lines can be used as a capacitor.

In the multi-spiral element 21 shown in FIG. 5, four groups of four spiral conductive lines in the 16 spiral conductive lines have external peripheral ends aligned at four cut lines C1—C1, C2—C2, C3—C3, and C4—C4, respectively.

The multi-spiral element 21 shown in FIG. 5 can be connected to four groups of straight conductive lines as leads, as indicated by arrows in FIG. 5. Then, the advantages when capacitors are connected between the four groups of straight conductive lines can be achieved.

Compared to an element including four wide spiral conductive lines rather than a multi-line element, the multi-spiral element, serving as a capacitor according to this modification of the first embodiment, can reduce the loss in the element and are small, as in the element shown in FIG. 4.

Although the conductive lines have been described above as being forcibly cut to produce the aligned external peripheral ends thereof, these aligned peripheral ends can also be produced by printing the conductive lines on the substrate in the desired pattern.

The relationship between the spiral conductive lines and the cut lines in the above-described first embodiment and modifications thereof is described below.

A spiral conductive line having a constant line width (hereinafter simply referred to as a "uniform spiral") is depicted schematically in FIG. 19.

Figure 19:
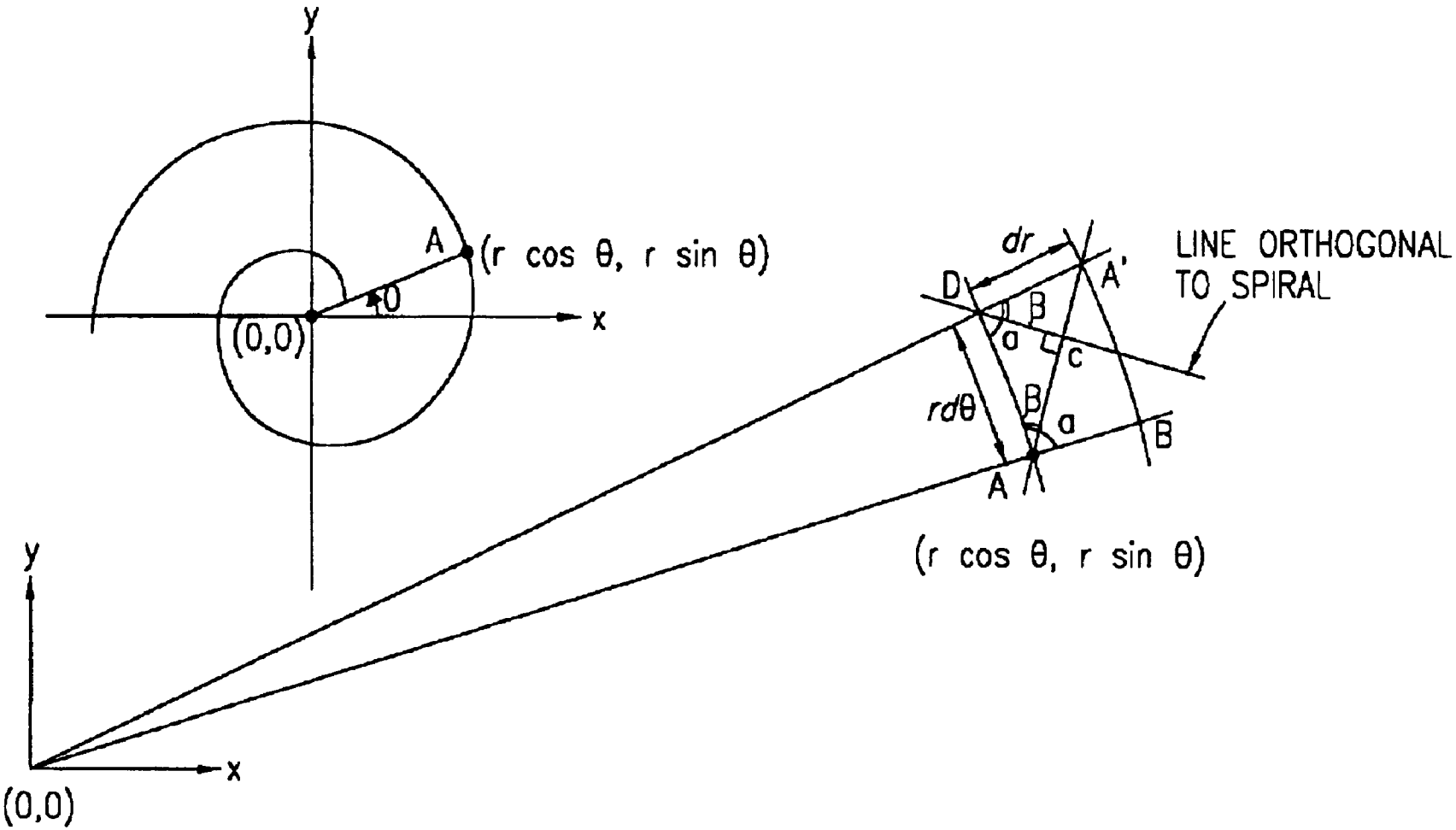
FIG. 19 is a view schematically showing a spiral line having a constant line width.

In FIG. 19, when the angle between the uniform spiral and the radius vector direction (r direction) is indicated by $\alpha$, and the angle between the curve orthogonal to the uniform spiral and the radius vector direction (r direction) is indicated by $\beta$, then the following expression is found between the uniform spiral and the radius vector direction:

$$\alpha + \beta = \frac{\pi}{2} \tag{1}$$

A differential equation which the curve orthogonal to the uniform spiral $$\frac{rd\theta}{dr} = -\tan\beta = -\tan\left(\frac{\pi}{2} - \alpha\right) = -\frac{1}{\tan\alpha} = -\frac{1}{\sqrt{\left(\frac{r}{r_0}\right)^2 - 1}} \tag{2}$$

satisfies in polar coordinate can be derived as follows:

When Equation (2) is rearranged in a separable form with respect to the polar variables (r, $\theta$), the following Equation (3) can be found:

The solution for Equation (3), which is a differential equation of the curve orthogonal to the uniform spiral, is as follows:

$$d\theta = -\frac{1}{r} \cdot \frac{1}{\sqrt{\left(\frac{r}{r_0}\right)^2 - 1}} \cdot dr \tag{3}$$

First, if a dimensionless intermediate variable is indicated by $$s = \frac{r_0}{r} \tag{4}$$

then, the following differential expressions with polar variables (r, θ) are obtained:

$$ds = -\frac{r0}{r^2}dr = -\frac{s}{r}dr \tag{5}$$

$$d\theta = \frac{1}{\sqrt{1-s^2}} \cdot ds \tag{6}$$

Equation (6) can be analytically integrated using elementary functions to find the following equation:

$$\theta = \int \frac{1}{\sqrt{1-s^2}} \cdot ds = \sin^{-1} s = \sin^{-1}\left(\frac{r_0}{r}\right) \tag{7}$$

where Equation (4) is used. Conversely, if Equation (7) is solved for r, then the following equation is found:

$$r = \frac{r_0}{\sin\theta} \tag{8}$$

When orthogonal variables (x, y) are substituted for the polar variables (r, θ), then the following expressions are found:

$$\begin{cases} x = r\cos\theta = \sqrt{r^2 - r_0^2} = r_0\sqrt{\left(\frac{r}{r_0}\right)^2 - 1} = r_0\tan\alpha \\ y = r\sin\theta = r_0 \end{cases} \tag{9}$$

It is therefore proved that the curve orthogonal to the uniform spiral is a tangent to a circle with the minimum radius $r_0$.

The configuration of a resonator according to a second embodiment of the present invention is now described with reference to FIGS. 6 and 7.

Figure 6:
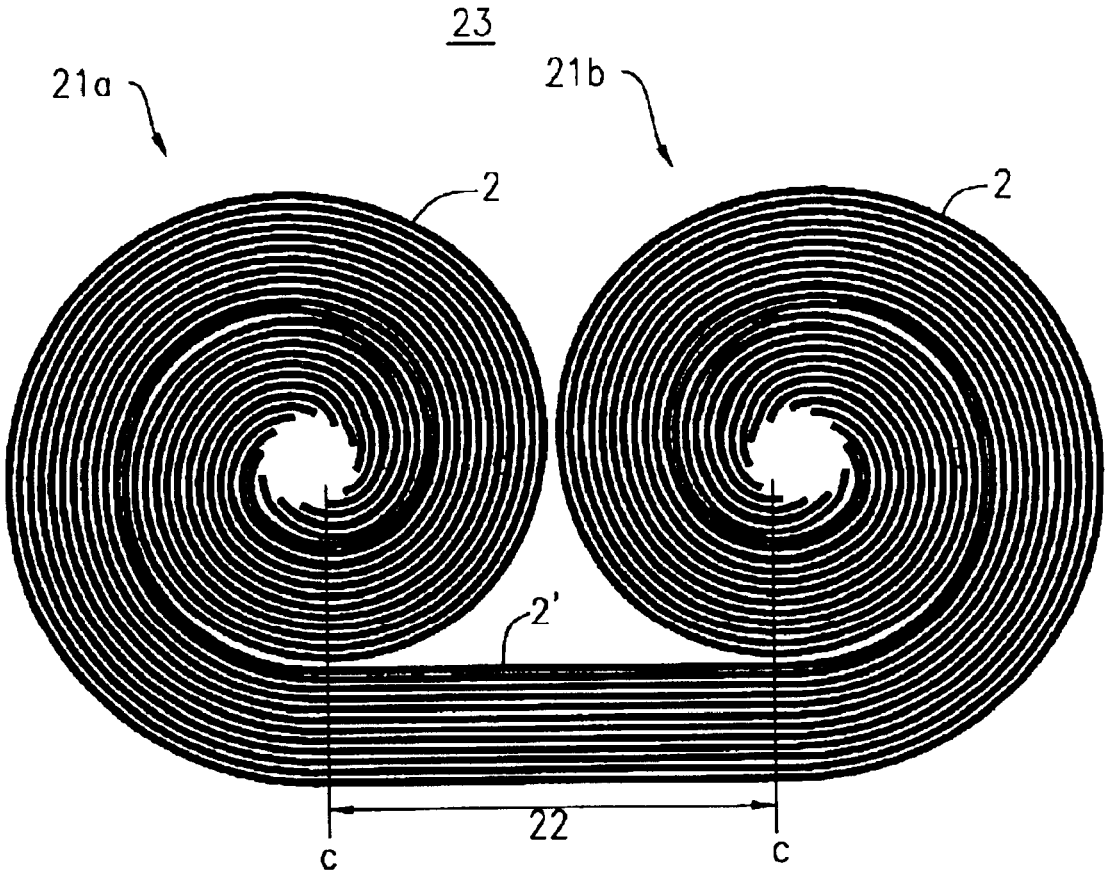
FIG. 6 is a schematic diagram of a resonator according to a second embodiment of the present invention.

FIG. 6 shows the configuration of a resonator 23 formed on a dielectric substrate. In FIG. 6, multi-spiral elements 21*a* and 21*b* have a similar configuration to the multi-spiral element 21 shown in FIG. 1. Each of the multi-spiral elements 21*a* and 21*b* includes a group of spiral conductive lines 2, whose external peripheral ends are aligned at a cut line C—C.

A straight-line-group element 22 is formed of a group of straight conductive lines 2'. One end of each of the straight conductive lines 2' is connected to each of the respective external peripheral ends of one conductive line of the plurality of spiral conductive lines in the multi-spiral element 21*a*. The straight-line-group element 22 is a multi-strip-line element. The straight-line-group element 22 provides a current route, or functions as an inductor.

When viewed as a lumped circuit, the resonator 23 shown in FIG. 6 serves as a resonator having an inductor and a capacitor connected in parallel.

In the resonator 23, the vicinities of the internal peripheral ends of the multi-spiral elements 21*a* and 21*b* exhibit voltage peaks and the center of the straight-line-group element 22 exhibits a voltage trough, while the center of the straight-line-group element 22 exhibits a current peak and the vicinities of the internal peripheral ends of the multi-spiral elements 21*a* and 21*b* exhibit current troughs. Thus, one of the multi-spiral elements 21*a* and 21*b* accumulates positive charge, and the other element accumulates negative charge. That is, a displacement current flows across the surface of the dielectric substrate or in the dielectric substrate, in the plane direction of the dielectric substrate, between the multi-spiral elements 21*a* and 21*b*. The actual current flows through the straight-line-group element 22.

Therefore, the resonator 23 shown in FIG. 6 operates as a half-wavelength resonator having conductive lines with both ends open.

The straight-line-group element 22 functioning as an inductor has low loss due to its multi-line structure. By optimizing the line width and thickness of the conductive lines, the straight-line-group element 22 can have improved characteristics independently of the multi-spiral elements 21*a* and 21*b* functioning as capacitors.

Figure 7:
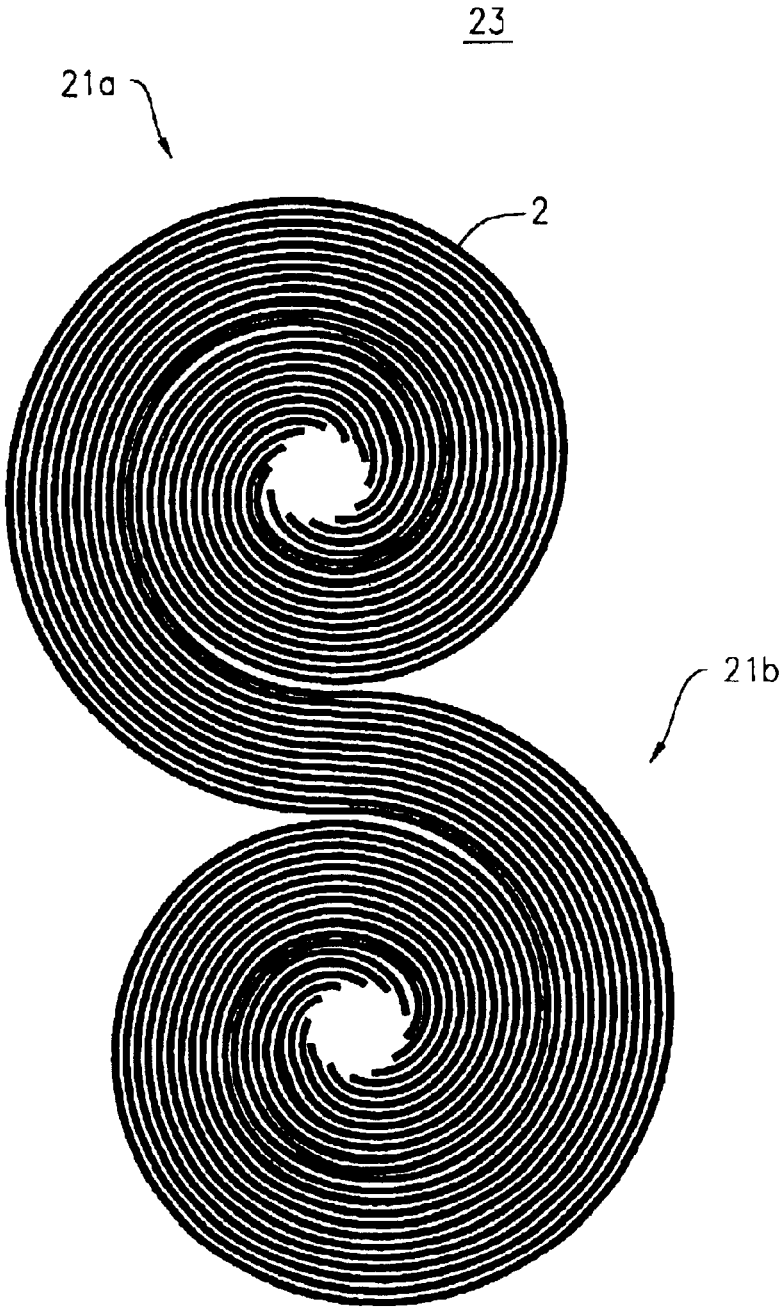
FIG. 7 is a schematic diagram of a modification of the resonator.

FIG. 7 shows a modification of the resonator 23 formed on a dielectric substrate. In FIG. 6, two multi-spiral elements 21*a* and 21*b* that are linearly symmetric with each other are connected through the straight-line-group element 22; in FIG. 7, however, the external peripheral ends of two multi-spiral elements 21*a* and 21*b* are directly connected to each other so that the multi-spiral elements 21*a* and 21*b* are point-symmetric with each other.

Without a straight-line-group element, therefore, front and rear regions including the connection between the two multi-spiral elements 21*a* and 21*b* can function as an inductor, thus achieving a resonator. In the resonator 23 shown in FIG. 7, the vicinities of internal peripheral ends of the multi-spiral elements 21*a* and 21*b* exhibit voltage peaks and the vicinity of the connection exhibits a voltage trough, while the vicinity of the connection exhibits a current peak and the vicinities of the internal peripheral ends of the multi-spiral elements 21*a* and 21*b* exhibit current troughs. Thus, one of the multi-spiral elements 21*a* and 21*b* accumulates positive charge, and the other element accumulates negative charge. Then, a displacement current and an actual current flow in the manner described above, thereby achieving a resonator.

Of course, a straight-line-group element having a predetermined length may be placed between the two multi-spiral elements 21*a* and 21*b* in FIG. 7.

The configuration of a resonator according to a third embodiment of the present invention is now described with reference to FIGS. 8 to 10.

Figure 8:
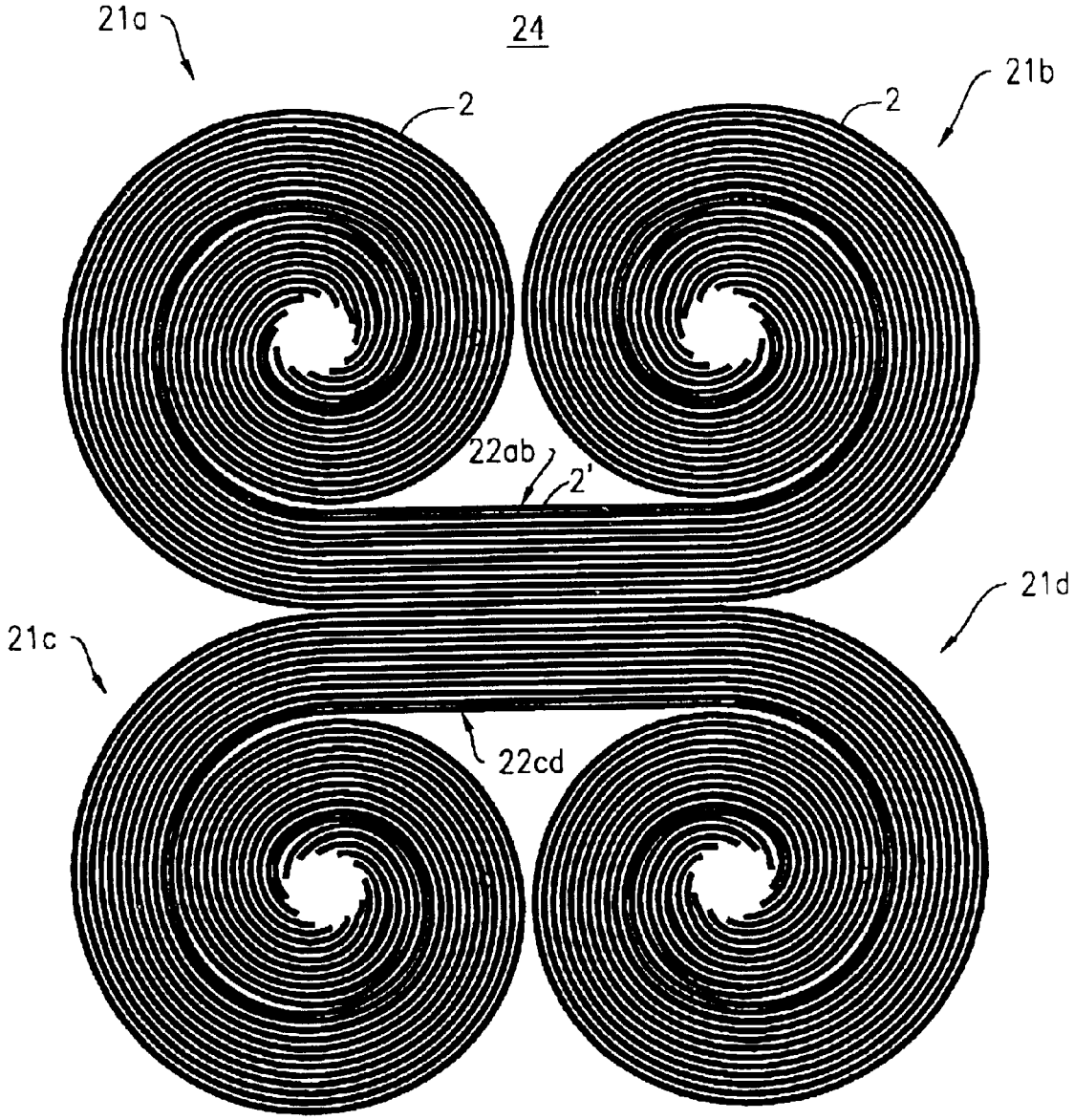
FIG. 8 is a schematic diagram of a resonator according to a third embodiment of the present invention.

FIG. 8 shows the configuration of a resonator 24 formed on a dielectric substrate. The resonator 24 is a quadrupole resonator having two bipolar resonators shown in FIG. 6. The resonator 24 shown in FIG. 8 includes two resonator assemblies. One resonator assembly is formed of multi-spiral elements 21*a* and 21*b*, and a straight-line-group element 22*ab*, and the other resonator assembly is formed of multi-spiral elements 21*c* and 21*d*, and a straight-line-group element 22*cd*. The straight-line-group elements 22*ab* and 22*cd* are arranged adjacent to and parallel to each other. In the resonator 24, the four multi-spiral elements 21*a* to 21*d* are horizontally and vertically symmetric to each other.

In this configuration, the straight-line-group elements 22*ab* and 22*cd* functioning as inductors are symmetric in the widthwise direction to each other, thus allowing a deviation in the current distribution to be mitigated in the widthwise direction, further reducing conductor loss as a whole.

FIG. 18C shows an example of the size of the resonator 24 shown in FIG. 8 in order to achieve the same resonant frequency characteristic as that of the stepped-impedance resonator in the related art. The resonator in the present invention therefore provides lower loss and is more compact than the stepped-impedance resonator in the related art.

Figure 9:
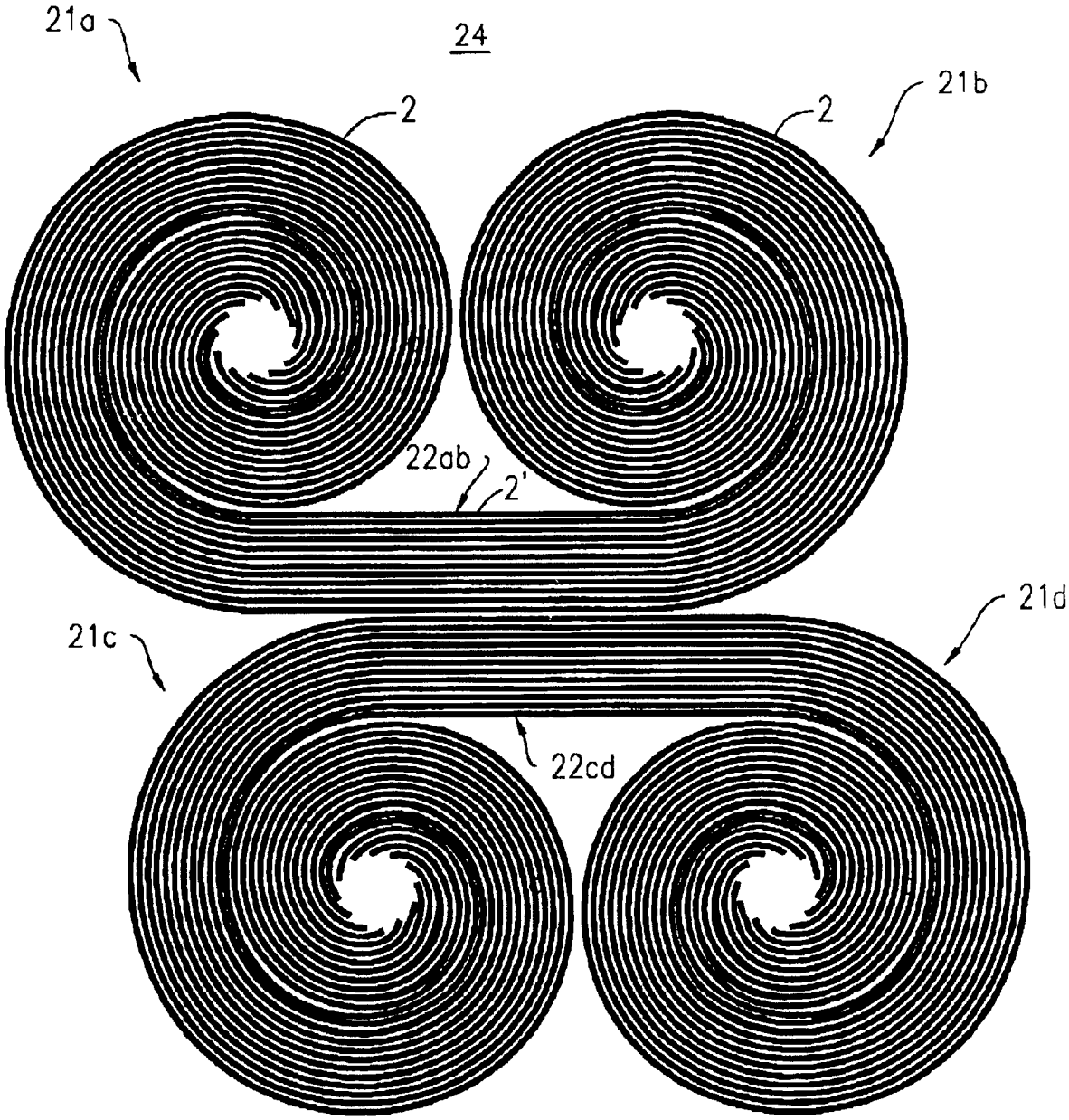
FIG. 9 is a schematic diagram of a modification of the resonator.

FIG. 9 shows a modification of the quadrupole resonator 24. In the resonator 24 shown in FIG. 8, the overall straight-line-group elements 22*ab* and 22*cd* are adjacent to each other. In the resonator 24 shown in FIG. 9, however, a portion of the straight-line-group element 22*ab* is adjacent to a portion of the straight-line-group element 22*cd* so as to be shifted by a predetermined distance in the lengthwise direction of the lines. This configuration allows electric and magnetic coupling between the straight-line-group elements 22*ab* and 22*cd* to be balanced, while allowing the resonator including the multi-spiral elements 21*a* and 21*b* to be coupled with the resonator including the multi-spiral elements 21*c* and 21*d* at a predetermined coupling intensity.

Figure 10:
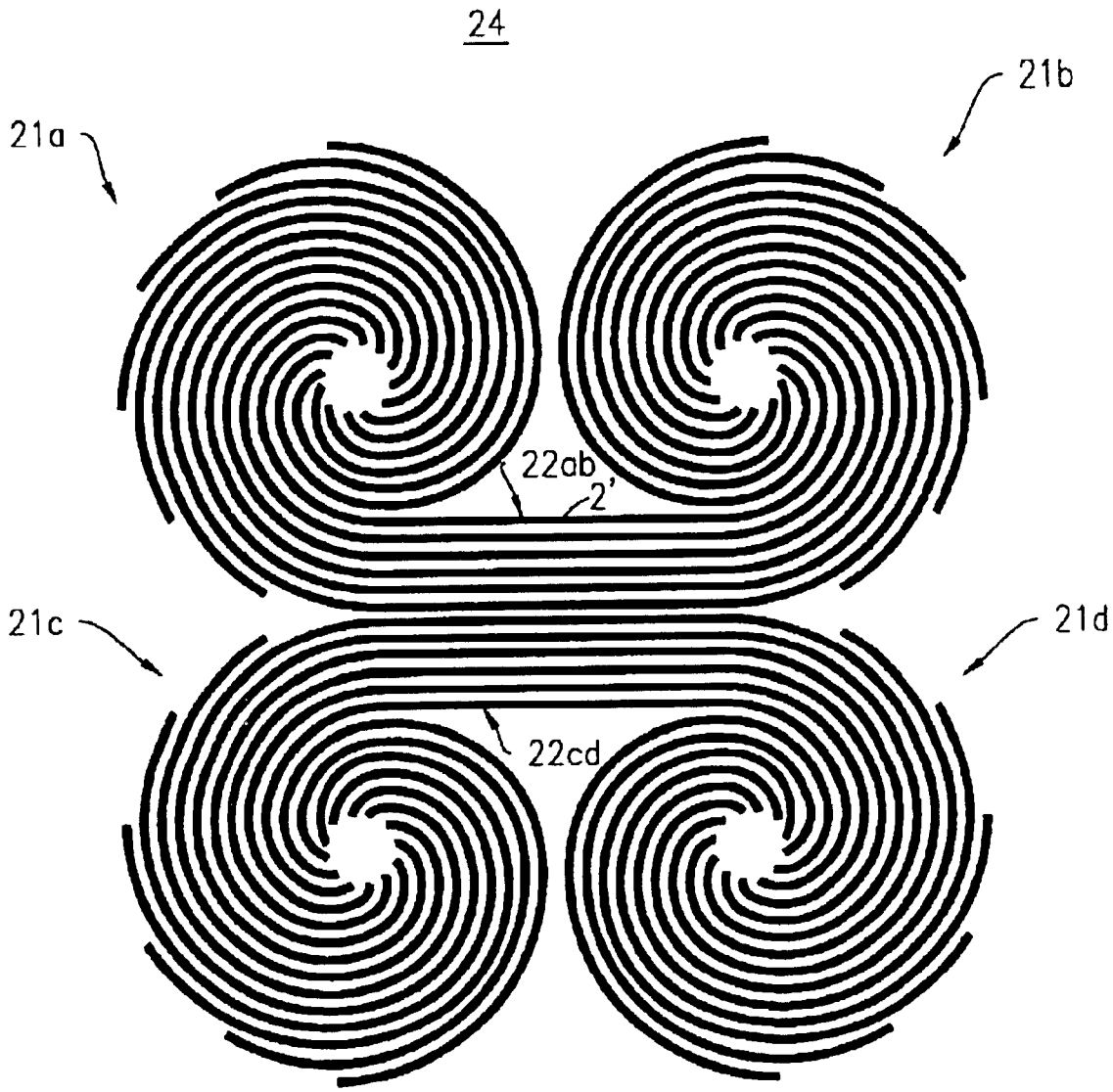
FIG. 10 is a schematic diagram of another modification of the resonator.

FIG. 10 shows another modification of the quadrupole resonator 24. In the resonator 24 shown in FIG. 8, all external peripheral ends of the plurality of spiral conductive lines in each of the four multi-spiral elements 21*a* to 21*d* are connected (continuous) to a straight-line-group element. In the resonator 24 shown in FIG. 10, however, only the external peripheral ends of a predetermined number of spiral conductive lines, out of the plurality of spiral conductive lines forming the four multi-spiral elements 21*a* to 21*d*, are connected to the straight-line-group elements 22*ab* and 22*cd*. With this configuration, the same advantages as those of the resonator 24 shown in FIG. 8 can be achieved.

The number of conductive lines which form the straight-line-group elements 22*ab* and 22*cd* is reduced, thereby increasing the inductance component of the straight-line-group elements 22*ab* and 22*cd* correspondingly. Therefore, the area of the dielectric substrate occupied by a resonator having a predetermined resonant frequency can be reduced without having to reduce the capacitance component of the multi-spiral elements 21*a* to 21*d*.

The configuration of a filter according to a fourth embodiment of the present invention is now described with reference to FIGS. 11A to 15B.

Figure 11A:
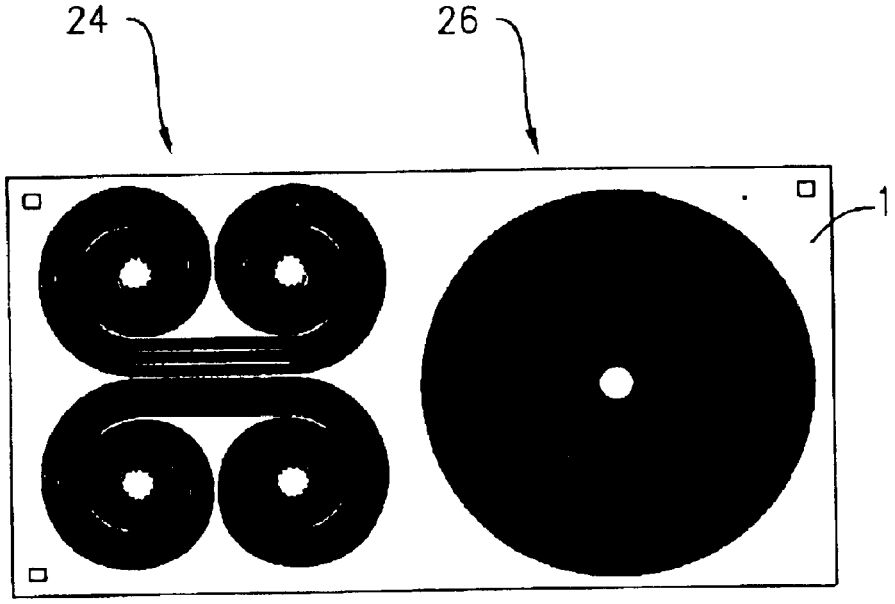
FIGS. 11A and 11B are plan views of a filter according to a fourth embodiment of the present invention.
Figure 11B:
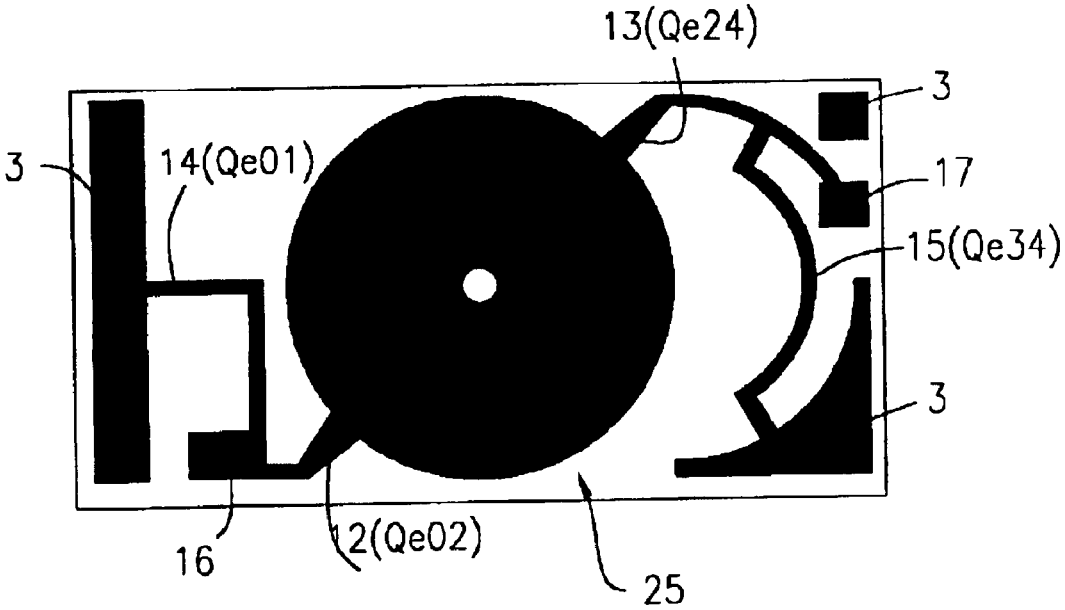

FIGS. 11A and 11B are a top plan view and a bottom plan view, respectively, of a dielectric substrate 1 forming a filter. Two resonators 24 and 26 are formed on the upper surface of the dielectric substrate 1. A resonator 25 is formed on the lower surface of the dielectric substrate 1. The resonator 24 is a quadrupole resonator having the configuration shown in FIG. 8. The resonators 25 and 26 are resonators each having a group of spiral conductive lines, as shown in FIG. 2. Although it is not shown in the drawing, the resonators 24, 25, and 26 preferably have over 100 conductive lines with a line width and gap of several micrometers.

A ground electrode 3, coupling electrodes 12, 13, 14, and 15, and terminals 16 and 17 are further formed on the lower surface of the dielectric substrate 1. The coupling electrode 14 is coupled to the resonator 24 on the upper surface of the dielectric substrate 1, while the coupling electrode 12 is coupled to the resonator 25. The coupling electrode 13 is also coupled to the resonator 25. The coupling electrode 15 is coupled to the resonator 26 on the upper surface of the dielectric substrate 1. The resonators 24 and 25 are not directly coupled to each other, and the resonators 25 and 26 are vertically coupled to each other through the dielectric substrate 1.

Accordingly, the resonator 24 shown in FIG. 11A and the resonator 25 shown in FIG. 11B are not directly coupled to each other. However, in FIGS. 11A and 11B, the resonator 24 on the upper surface and the resonator 25 on the lower surface of the dielectric substrate 1 are slightly shifted with respect to each other, and are weakly coupled to each other.

Figure 12:
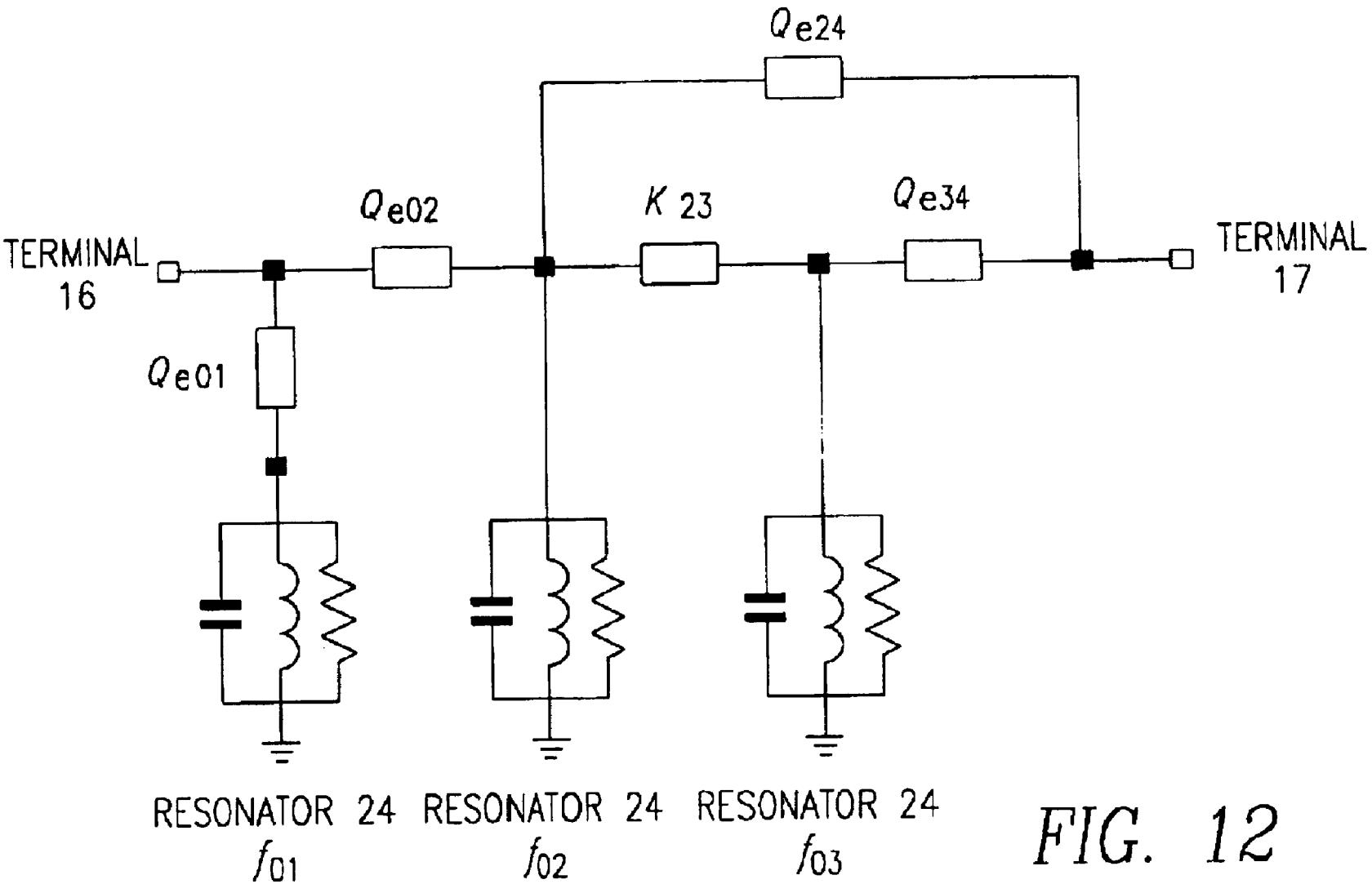
FIG. 12 is an equivalent circuit diagram of the filter shown in FIGS. 11A and 11B.

FIG. 12 is an equivalent circuit diagram of the filter shown in FIG. 11. The resonators 24, 25, and 26 are represented as LCR parallel resonant circuits. The coupling electrodes 14, 12, 13, and 15 are indicated by coupling circuits $Q_{e01}$, $Q_{e02}$, $Q_{e24}$, and $Q_{e34}$, respectively. A coupling circuit k23 is adapted to couple the resonator 25 to the resonator 26. Therefore, while the resonator 24 serves as a trap resonator, the resonators 25 and 26 serve as two-stage coupled resonators.

Figure 13:
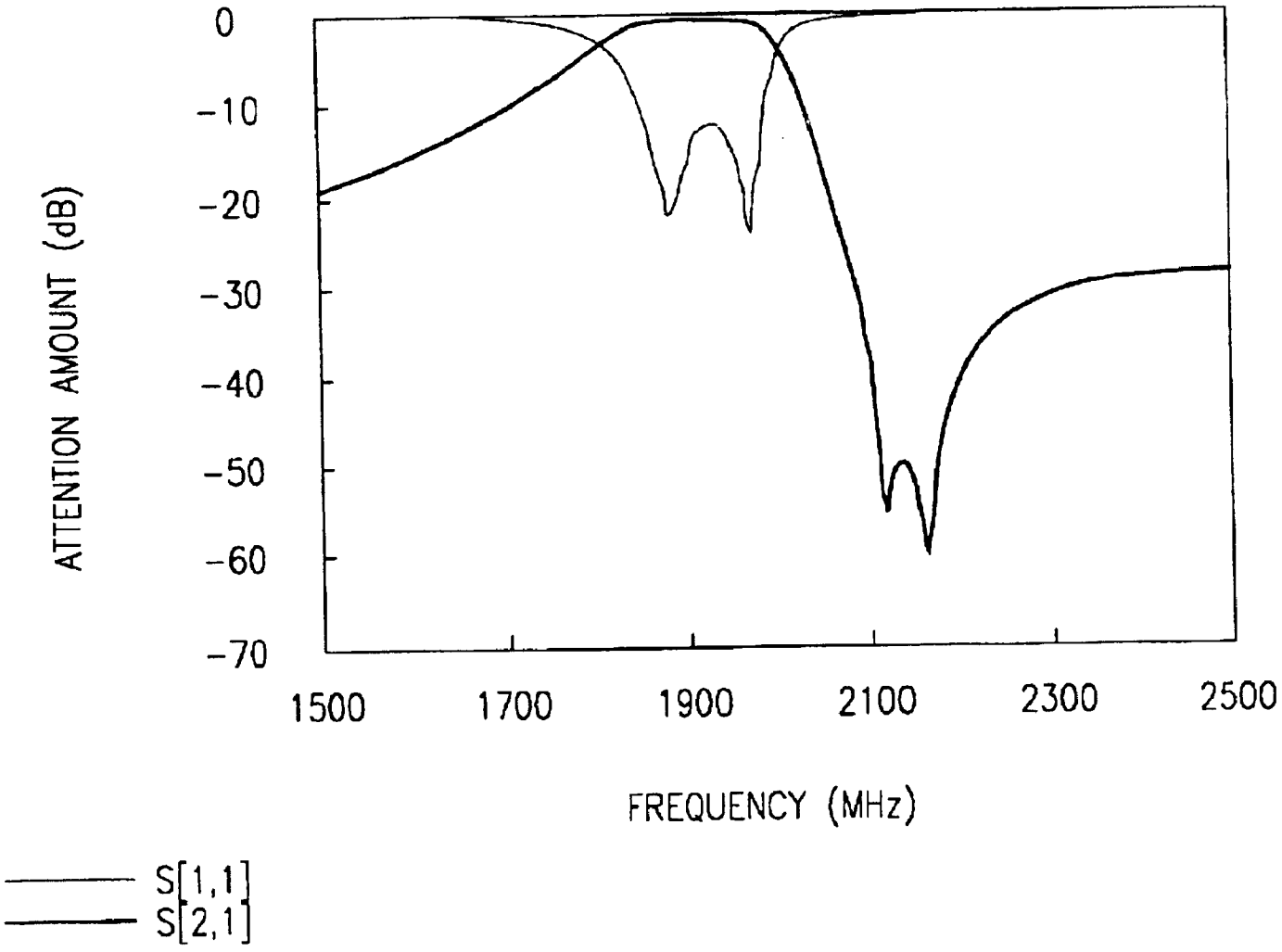
FIG. 13 is a graph showing filter characteristics of the filter shown in FIGS. 11A and 11B.

FIG. 13 shows examples of transmission characteristics S[1,1] and reflection characteristics S[2,1], where circuit constants are as follows:

$f_{01}$=2115.525 MHz;

$f_{02}$=1922.397 MHz;

$f_{03}$=1901.024 MHz;

$Q_{e01}$=9.66;

$Q_{e02}$=16.4;

$k_{23}$=7.198%;

$Qe_{34}$=17.0; and $Q_{24}$=173.

Therefore, a bandpass characteristic having an attenuation region produced by the trap resonator can be achieved.

Coupling between a plurality of resonators formed on a single dielectric substrate is now described with reference to FIGS. 14A to 15B.

Figure 14A:
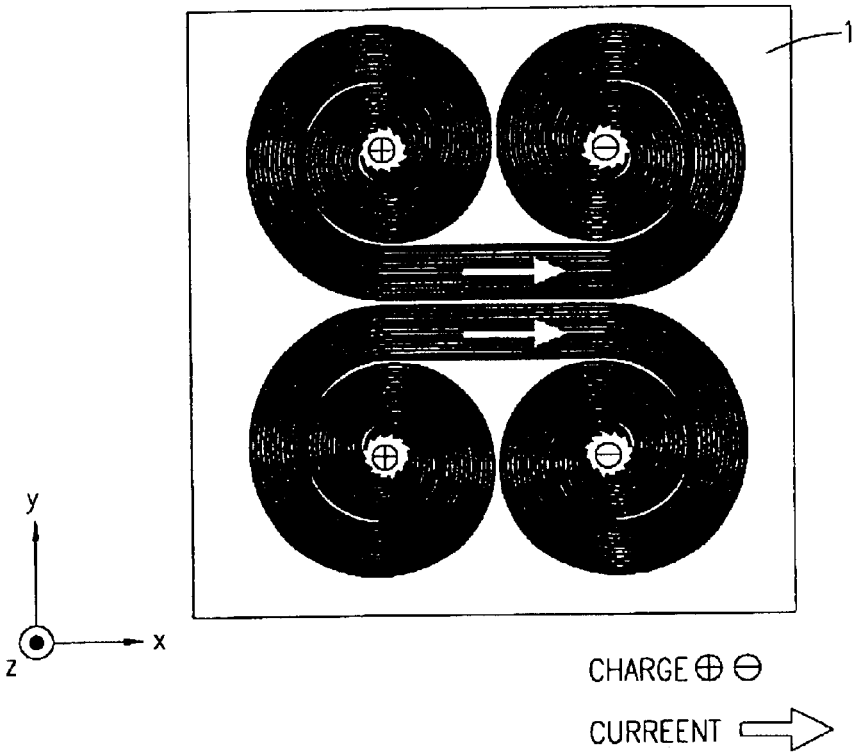
FIGS. 14A and 14B are plan views illustrating coupling between resonators.
Figure 14B:
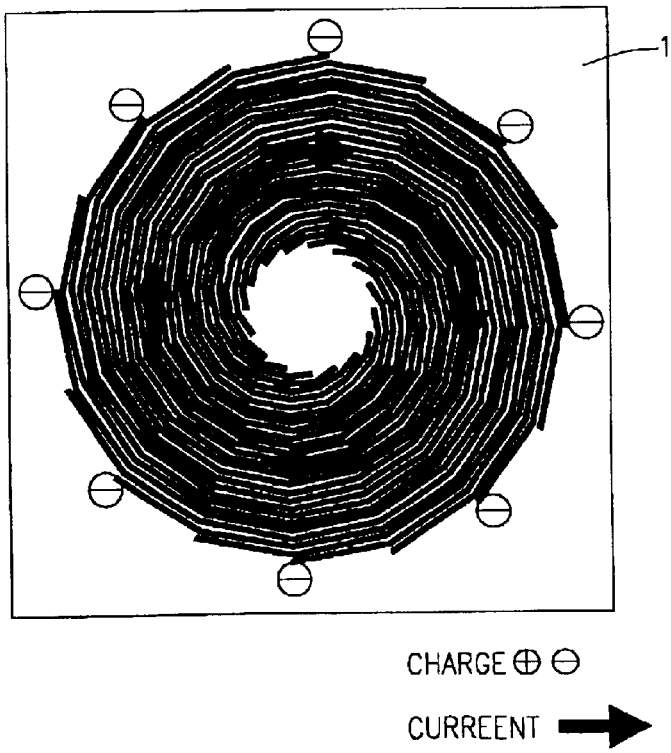

FIGS. 14A and 14B are a top plan view and a bottom plan view of a dielectric substrate 1, respectively. A quadrupole resonator and a resonator having a group of spiral conductive lines are formed on the upper and lower surfaces of the dielectric substrate 1, respectively. A process to reverse a charge in the quadrupole resonator formed on the upper surface of the dielectric substrate 1 is considered. This process is equivalent to a process to rotate a symmetric resonator by 180° with respect to the z axis.

The electromagnetic field mode when the resonator formed on the upper surface of the dielectric substrate 1 and the resonator formed on the lower surface of the dielectric substrate 1 are rotated by 180° is the same as the original electromagnetic field mode as to both accumulated energy and frequency. Thus, the mode for the two resonators formed on the upper and lower surfaces of the dielectric substrate 1 is a degeneration mode. That is, the two resonators on the upper and lower surfaces of the dielectric substrate 1 are not coupled to each other.

Figure 15A:
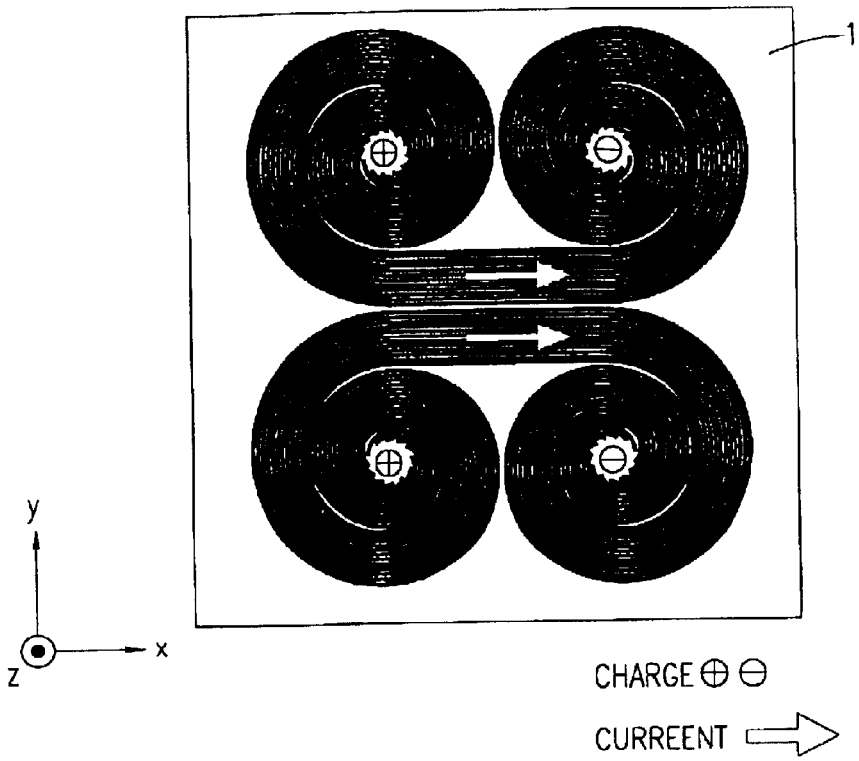
FIGS. 15A and 15B are plan views illustrating coupling between resonators.
Figure 15B:
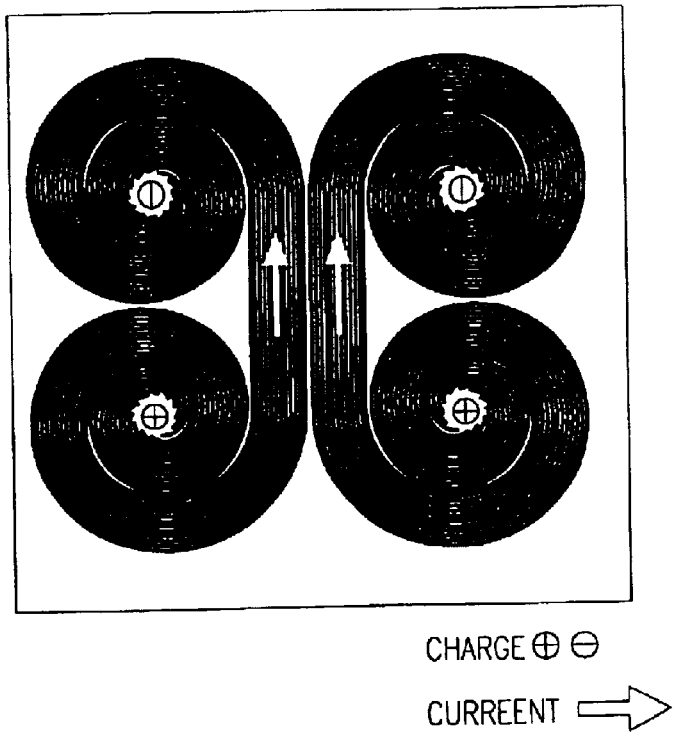

FIGS. 15A and 15B are a top plan view and a bottom plan view of a dielectric substrate 1, respectively. Two quadrupole resonators are formed on the upper and lower surfaces of the dielectric substrate 1, respectively. A process to reverse a charge (reverse the current flow direction) in the quadrupole resonator formed on the upper surface of the dielectric substrate 1 is considered. This process is equivalent to a process to spatially mirror-reverse a symmetric resonator with respect to the y-z plane.

The electromagnetic field mode for the mirror-inverted resonators is the same as the original electromagnetic field mode with respect to both accumulated energy and frequency. Thus, the mode for the two resonators formed on the upper and lower surfaces of the dielectric substrate 1 is a degeneration mode. That is, the two resonators on the upper and lower surfaces of the dielectric substrate 1 are not coupled to each other.

The configuration of a duplexer according to an aspect of the present invention is now described with reference to FIG. 16.

Figure 16:
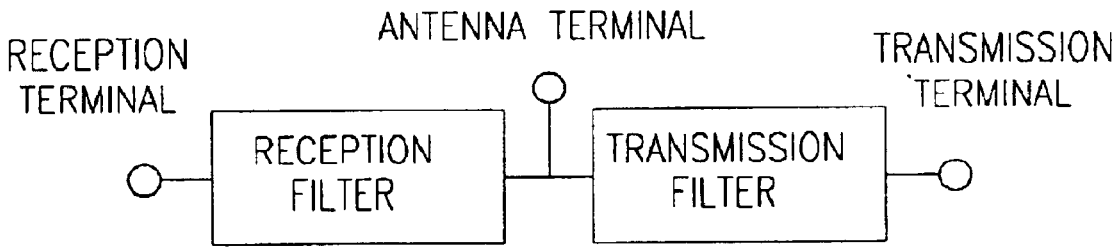
FIG. 16 is a block diagram of a duplexer according to a fifth embodiment of the present invention.

In FIG. 16, a transmission filter and a reception filter are filters having the configuration shown in FIGS. 11A and 11B, etc. Filter characteristics should be defined so that the attenuation region produced by the trap resonator is adjacent to the pass bands of the opposite filters, i.e., the reception band for the transmission filter and the transmission band for the reception filter.

A phase control is performed between the output port of the transmission filter and the input port of the reception filter in order to prevent a transmission signal from being passed towards the reception filter and a received signal from being passed towards the transmission filter.

The configuration of a communication apparatus according to a sixth embodiment of the present invention is now described with reference to FIG. 17.

Figure 17:
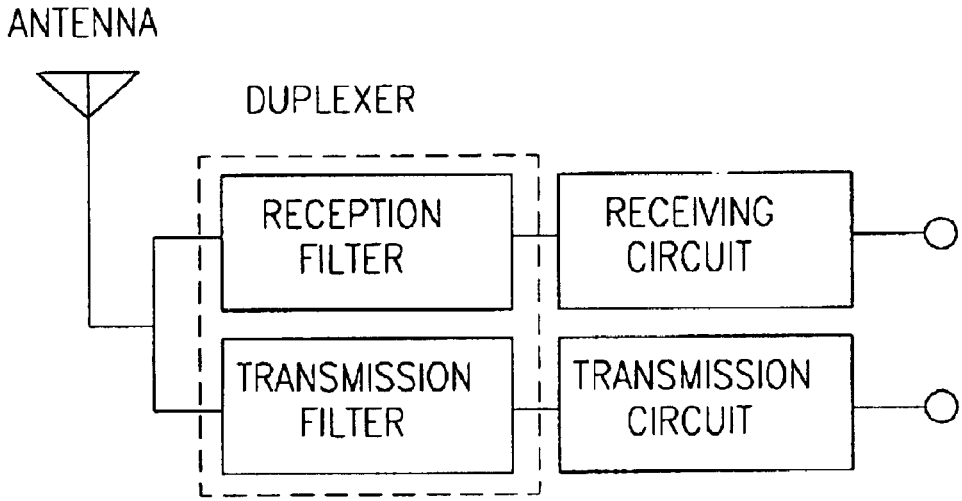
FIG. 17 is a block diagram of a communication apparatus according to a sixth embodiment of the present invention.

In FIG. 17, a communication apparatus is formed with the duplexer shown in FIG. 16. The transmission terminal and the reception terminal of the duplexer are connected to a transmitting circuit and a receiving circuit, respectively. The antenna terminal is connected to an antenna.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A circuit element comprising:

a substrate; and a group of conductive lines arranged in a spiral about a common point on a surface of the substrate such that each of the conductive lines in the group of conductive lines do not cross each others wherein a set of conductive lines of the group of conductive lines have external peripheral ends aligned along a substantially straight line substantially orthogonal to the group of conductive lines.

2. The circuit element according to claim 1, wherein the group of conductive lines are arranged so as to be substantially rotationally symmetric about the point on the substrate.

3. The circuit element according to claim 1, wherein each of the conductive lines in the group of conductive lines are angled so as to form a polygon.

4. The circuit element according to claim 1, wherein an end of all of the conductive lines of the group of conductive lines are aligned with each other.

5. The circuit element according to claim 1, wherein an end of each of a first plurality of conductive lines of the group of conductive lines are aligned with each other; and an end of each of a second plurality of conductive lines of the group of conductive lines are aligned with each other.

6. The circuit element according to claim 1, wherein an end of each of a first plurality of conductive lines of the group of conductive lines are aligned with each other; an end of each of a second plurality of conductive lines of the group of conductive lines are aligned with each other; an end of each of a third plurality of conductive lines of the group of conductive lines are aligned with each other; an end of each of a fourth plurality of conductive lines of the group of conductive lines are aligned with each other.

7. A circuit element comprising:

a substrate; and a group of conductive lines arranged in a spiral about a common point on a surface of the substrate such that each of the conductive lines in the group of conductive lines do not cross each other, wherein an end of all of the conductive lines of the group of conductive lines are aligned with each other, and wherein at least two of the conductive lines in the group of conductive lines have different lengths.

8. A circuit element comprising:

a substrate; and a group of conductive lines arranged in a spiral about a common point on a surface of the substrate such that each of the conductive lines in the group of conductive lines do not cross each other, wherein an end of each of a subset of conductive lines in the group of conductive lines are aligned with each other.

9. A resonator comprising:

a substrate;

a first group of conductive lines arranged in a spiral about a first point on a surface of the substrate such that each of the conductive lines in the first group of conductive lines do not cross each other; and a second group of conductive lines arranged in a spiral about a second point on the surface of the substrate such that each of the conductive lines in the second group of conductive lines do not cross each other, wherein a plurality of conductive lines of the first group of conductive lines are connected to a respective plurality of conductive lines of the second group of conductive lines, a first set of conductive lines of the first group of conductive lines have external peripheral ends aligned along a substantially straight line substantially orthogonal to the first group of conductive lines, and a second set of conductive lines of the second group of conductive lines have external peripheral ends aligned along a substantially straight line substantially orthogonal to the second group of conductive lines.

10. The resonator according to claim 9, wherein the plurality of conductive lines of the first group of conductive lines are connected to the respective plurality of conductive lines of the second group of conductive lines by a straight-line-group element having a respective plurality of substantially straight lines.

11. The resonator according to claim 10, wherein:

an end of each of the plurality of conductive lines of the first group of conductive lines are aligned with each other;

an end of each of the plurality of conductive lines of the second group of conductive lines are aligned with each other; and the straight-line-group element is connected between the ends of the plurality of conductive lines of the first group of conductive lines and the ends of the plurality of conductive lines of the second group of conductive lines.

12. The resonator according to claim 9, further comprising:

a third group of conductive lines arranged in a spiral about a third point on the surface of the substrate such that each of the conductive lines in the third group of conductive lines do not cross each other;

a fourth group of conductive lines arranged in a spiral about a fourth point on the surface of the substrate such that each of the conductive lines in the fourth group of conductive lines do not cross each other, wherein the plurality of conductive lines of the first group of conductive lines are connected to the respective plurality of conductive lines of the second group of conductive lines by a first straight-line-group element having a respective plurality of substantially straight lines to form a first resonator assembly, a plurality of conductive lines of the third group of conductive lines are connected to a respective plurality of conductive lines of the fourth group of conductive lines by a second straight-line-group element having a respective plurality of substantially straight lines to form a second resonator assembly, and the first straight-line-group element is arranged adjacent to the second straight-line-group element.

13. The resonator according to claim 12, wherein the first resonator assembly and the second resonator assembly are symmetrically arranged relative to each other on the surface of the substrate.

14. A resonator comprising:

a substrate;

a first group of conductive lines arranged in a spiral about a first point on a surface of the substrate such that each of the conductive lines in the first group of conductive lines do not cross each other;

a second group of conductive lines arranged in a spiral about a second point on the surface of the substrate such that each of the conductive lines in the second group of conductive lines do not cross each other;

a third group of conductive lines arranged in a spiral about a third point on the surface of the substrate such that each of the conductive lines in the third group of conductive lines do not cross each other; and a fourth group of conductive lines arranged in a spiral about a fourth point on the surface of the substrate such that each of the conductive lines in the fourth group of conductive lines do not cross each other, wherein a plurality of conductive lines of the first group of conductive lines are connected to a respective plurality of conductive lines of the second group of conductive lines by a first straight-line-group element having a respective plurality of substantially straight lines to form a first resonator assembly, a plurality of conductive lines of the third group of conductive lines are connected to a respective plurality of conductive lines of the fourth group of conductive lines by a second straight-line-group element having a respective plurality of substantially straight lines to form a second resonator assembly, the first straight-line-group element is arranged adjacent to the second straight-line-group, element, and the first resonator assembly and the second resonator assembly are arranged offset relative to each other on the surface of the substrate.

15. A resonator comprising:

a substrate;

a first group of conductive lines arranged in a spiral about a first point on a surface of the substrate such that each of the conductive lines in the first group of conductive lines do not cross each other;

a second group of conductive lines arranged in a spiral about a second point on the surface of the substrate such that each of the conductive lines in the second group of conductive lines do not cross each other;

a third group of conductive lines arranged in a spiral about a third point on the surface of the substrate such that each of the conductive lines in the third group of conductive lines do not cross each other; and a fourth group of conductive lines arranged in a spiral about a fourth point on the surface of the substrate such that each of the conductive lines in the fourth group of conductive lines do not cross each other, wherein a plurality of conductive lines of the first group of conductive lines are connected to a respective plurality of conductive lines of the second group of conductive lines by a first straight-line-group element having a respective plurality of substantially straight lines to form a first resonator assembly, a plurality of conductive lines of the third group of conductive lines are connected to a respective plurality of conductive lines of the fourth group of conductive lines by a second straight-line-group element having a respective plurality of substantially straight lines to form a second resonator assembly, the first straight-line-group element is arranged adjacent to the second straight-line-group element, and the first group of conductive lines and the second group of conductive lines are reversely tuned with respect to each other.

16. The resonator according to claim 15, wherein the third group of conductive lines and the fourth group of conductive lines are reversely tuned with respect to each other.

17. A filter comprising:

a substrate having an upper surface and a lower surface;

a first resonator arranged on the upper surface of the substrate, the first resonator including:

a first group of conductive lines arranged in a spiral about a first point on the upper surface of the substrate such that each of the conductive lines in the first group of conductive lines do not cross each other; and a second resonator arranged on the lower surface of the substrate, the second resonator including:

a second group of conductive lines arranged in a spiral about a second point on the lower surface of the substrate such that each of the conductive lines in the second group of conductive lines do not cross each other, wherein a first set of conductive lines of the first group of conductive lines have external peripheral ends aligned alone a substantially straight line substantially orthogonal to the first group of conductive lines, and a second set of conductive lines of the second group of conductive lines have external peripheral ends aligned along a substantially straight line substantially orthogonal to the second group of conductive lines.

18. The filter according to claim 17, wherein the first resonator further comprises:

a third group of conductive lines arranged in a spiral about a third point on the upper surface of the substrate such that each of the conductive lines in the third group of conductive lines do not cross each other, wherein a plurality of conductive lines of the first group of conductive lines are connected to a respective plurality of conductive lines of the third group of conductive lines.

19. The filter according to claim 18, wherein the first resonator further includes:

a fourth group of conductive lines arranged in a spiral about a fourth point on the upper surface of the substrate such that each of the conductive lines in the fourth group of conductive lines do not cross each other;

a fifth group of conductive lines arranged in a spiral about a fifth point on the upper surface of the substrate such that each of the conductive lines in the fifth group of conductive lines do not cross each other, wherein the plurality of conductive lines of the first group of conductive lines are connected to the respective plurality of conductive lines of the third group of conductive lines by a first straight-line-group element having a respective plurality of substantially straight lines, a plurality of conductive lines of the fourth group of conductive lines are connected to a respective plurality of conductive lines of the fifth group of conductive lines by a second straight-line-group element having a respective plurality of substantially straight lines, and the first straight-line-group element is arranged adjacent to the second straight-line-group element.

20. The filter according to claim 19, wherein the second resonator further includes:

a sixth group of conductive lines arranged in a spiral about a sixth point on the lower surface of the substrate such that each of the conductive lines in the sixth group of conductive lines do not cross each other, a seventh group of conductive lines arranged in a spiral about a seventh point on the lower surface of the substrate such that each of the conductive lines in the seventh group of conductive lines do not cross each other; and an eighth group of conductive lines arranged in a spiral about an eighth point on the lower surface of the substrate such that each of the conductive lines in the eighth group of conductive lines do not cross each other, wherein a plurality of conductive lines of the second group of conductive lines are connected to a respective plurality of conductive lines of the sixth group of conductive lines by a third straight-line-group element having a respective plurality of substantially straight lines, a plurality of conductive lines of the seventh group of conductive lines are connected to a respective plurality of conductive lines of the eighth group of conductive lines by a fourth straight-line-group element having a respective plurality of substantially straight lines, and the third straight-line-group element is arranged adjacent to the fourth straight-line-group element.

* * * * *